US007887300B2

(12) United States Patent
Mazzola et al.

(10) Patent No.: US 7,887,300 B2
(45) Date of Patent: Feb. 15, 2011

(54) CMC AIRFOIL WITH THIN TRAILING EDGE

(75) Inventors: Stefan Mazzola, Sanford, FL (US); Bonnie Marini, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 879 days.

(21) Appl. No.: 11/711,842

(22) Filed: Feb. 27, 2007

(65) Prior Publication Data

US 2008/0203236 A1 Aug. 28, 2008

(51) Int. Cl.
*F03B 3/12* (2006.01)

(52) U.S. Cl. ..... 416/241 B; 416/224

(58) Field of Classification Search ..... 416/229 A, 416/241 B, 62, 224
See application file for complete search history.

(56) References Cited

U.S. PATENT DOCUMENTS

| | | | |
|---|---|---|---|
| 3,011,762 | A | 12/1961 | Pouit |
| 3,619,077 | A | 11/1971 | Wile et al. |
| 4,871,132 | A | 10/1989 | Finsterwalder |
| 6,197,424 | B1 | 3/2001 | Morrison et al. |
| 6,200,092 | B1 | 3/2001 | Koschier |
| 6,451,416 | B1 | 9/2002 | Holowczak et al. |
| 6,696,144 | B2 | 2/2004 | Holowczak et al. |
| 7,066,717 | B2 | 6/2006 | Morrison et al. |
| 2006/0019087 | A1 | 1/2006 | Mazzola et al. |
| 2006/0226290 | A1 | 10/2006 | Campbell |
| 2006/0285973 | A1 * | 12/2006 | Keller ..... 416/97 R |

FOREIGN PATENT DOCUMENTS

| | | | |
|---|---|---|---|
| JP | 58047103 | A | 3/1983 |

* cited by examiner

*Primary Examiner*—Edward Look
*Assistant Examiner*—Dwayne J White

(57) ABSTRACT

An airfoil (10) as may be used in a gas turbine engine includes a ceramic matrix composite (CMC) element (12) that extends to define a leading edge portion (14) and chord portion (16) of the airfoil, and a separately formed but conjoined trailing edge element (18) that defines a desirably thin trailing edge of the airfoil without the need for using an excessively small bend radius for reinforcing fibers in the CMC element. The trailing edge element may include a plurality of interlock elements (26) that extend through the trailing edge attachment wall (22) of the CMC element and provide mechanical attachment there between. Alternatively, the trailing edge element may be adhesively bonded or sinter bonded to the CMC element. A cooling air insert (60) may be disposed within a cooling air cavity (64) of the CMC element and may include cooling tubes (66) that extend into the trailing edge element to deliver cooling air there through.

16 Claims, 3 Drawing Sheets

CMC AIRFOIL WITH THIN TRAILING EDGE

FIELD OF THE INVENTION

This invention relates generally to a ceramic matrix composite airfoil such as may be used in a gas turbine engine.

BACKGROUND OF THE INVENTION

The design of the trailing edge of an airfoil is preferably dictated by aerodynamic considerations. For improved aerodynamic performance, it is commonly preferred to provide a thin trailing edge for a gas turbine airfoil. However, thinness may result in weakness, and there are often structural limitations that limit the trailing edge design and necessitate the use of an aerodynamic design that is less than optimal.

It is known to use ceramic matrix composite (CMC) materials for airfoils and other components of gas turbine engines. CMC materials advantageously provide higher temperature capability than metal and a high strength to weight ratio. The reinforcing fibers of the CMC material are preferably wrapped around the trailing edge of an airfoil between the pressure and suction sides of the airfoil in order to provide strength to the trailing edge. However, the lower limit of the radius that may be made with a ceramic fiber may necessitate a trailing edge thickness that is greater than desired. Furthermore, the layer of ceramic insulating material that may be deposited over the CMC material in order to protect the CMC material from the hot working gas temperatures further exacerbates the trailing edge thickness issue.

U.S. Pat. No. 6,200,092 describes a gas turbine airfoil that includes a CMC leading edge segment and a separate monolithic ceramic chord segment that extends to a desirably thin trailing edge. However, because of the large aerodynamic loads imposed on the airfoil, it is necessary that the monolithic chord segment be formed of high strength structural ceramic, such as silicon nitride, and that it be supported separately from the leading edge segment with a special mounting arrangement. The separation between the segments also necessitates the use of a special seal there between, and it creates an undesirable gap along the airfoil surface. These design features and requirements adversely impact the cost, complexity and aerodynamic performance of the airfoil. Thus, further improvements in ceramic airfoil designs are desired.

BRIEF DESCRIPTION OF THE DRAWINGS

The invention is explained in the following description in view of the drawings that show.

DETAILED DESCRIPTION OF THE INVENTION

Figure 1:
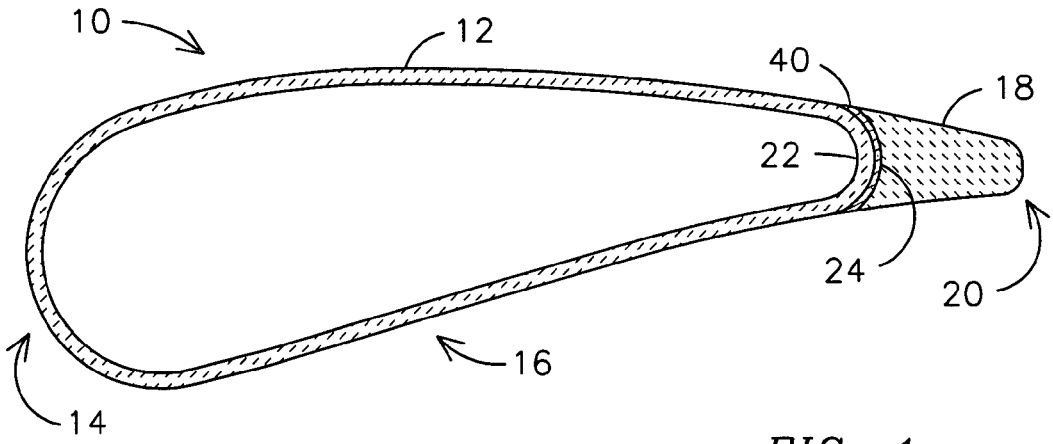
FIG. 1 is a cross-sectional view of an airfoil having a ceramic matrix composite element and an attached trailing edge element.

An improved airfoil 10 as may be used in a gas turbine engine is illustrated in FIG. 1. The airfoil 10 includes a ceramic matrix composite (CMC) element 12 defining a leading edge portion 14 and a chord portion 16 of the airfoil 10, and a trailing edge element 18 supported by the ceramic matrix composite element 12 and defining a trailing edge portion 20 of the airfoil. The CMC element 12 may be formed of any known type of ceramic matrix composite material as may be suitable for a particular application. The ceramic matrix composite element 12 is formed with a trailing edge attachment wall 22 having a bend radius sufficiently large to avoid damage to ceramic reinforcing fibers (not illustrated) of the wall 22. The trailing edge element 18 includes a chord attachment wall 24 configured to cooperate with the trailing edge attachment wall 22 for attachment thereto. FIG. 1 may be interpreted to represent the trailing edge element 18 being formed of a monolithic ceramic material, a stacked laminate ceramic matrix composite material, a non-structural ceramic material, a non-structural ceramic material reinforced with chopped ceramic fibers, and/or a metal alloy material in various embodiments. One such non-structural ceramic material is known as friable-grade insulation (FGI), which is described in various embodiments in U.S. Pat. No. 6,197,424 and United States patent application publication number US 2006/0019087, both incorporated by reference herein. The cross section of the trailing edge element may have a solid configuration or a hollow configuration with any thickness of wall in various embodiments.

In various embodiments of the present invention, the ceramic matrix composite element 12 extends along at least 70% or at least 80% or at least 90% of the chord length of the airfoil 10. The relatively short chord length of the trailing edge element 18 tends to minimize the aerodynamic loadings imposed on the trailing edge element 18, because the bending of the working fluid passing over the airfoil 10 is accomplished almost fully across the chord portion 16. This facilitates the direct attachment between the CMC element 12 and the trailing edge element 18 because the loads there between are minimized. The attachment between the two elements 12, 18 may be an adhesive bond, any appropriate type of mechanical attachment, or, it may be a sinter bond in an embodiment wherein the trailing edge element 18 is a ceramic material.

Figure 2:
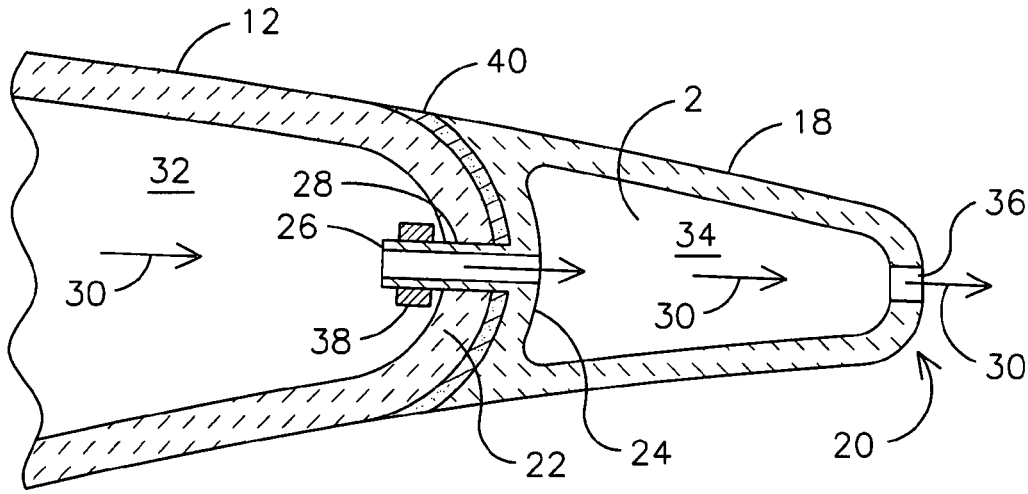
FIG. 2 is a partial cross-sectional view of the airfoil of FIG. 1 at a radial location of an interlock feature.

FIG. 2 is a partial cross-sectional view of the airfoil of FIG. 1 at a different radial (i.e. perpendicular to the chord direction) location than is illustrated in FIG. 1. The location of the cross-section of FIG. 2 is selected to illustrate one embodiment of the attachment between the CMC element 12 and the trailing edge element 18. At this location the trailing edge element 18 includes an interlock element 26 extending from the chord attachment wall 24 to penetrate the trailing edge attachment wall 22 of the ceramic matrix composite element 12. One skilled in the art will appreciate that an interlock element may extend from the trailing edge attachment wall to penetrate the chord attachment wall in other embodiments. The interlock element 26 penetrates the CMC element 12 through an opening 28 that may be initially formed in the trailing edge attachment wall 22 or that may be drilled or otherwise formed into the wall 22 after construction. One or both of the trailing edge element 18 and/or the interlock element 26 may be of solid construction. Alternatively, they may both be of hollow construction such that a cooling fluid such as compressed air 30 may pass from a cooling fluid cavity 32 of the CMC element 12, through the hollow center of the interlock element 26, into a cooling fluid cavity 34 of the trailing edge element 18, and out into the working fluid passing over the airfoil 10 through a cooling fluid outlet hole 36 formed along the trailing edge portion 20, either through trailing edge ejections (as shown), pressure side ejection, routing to the shrouds, or any alternate appropriate coolant exit route. The interlock element 26 may provide only a mechanical interference with the trailing edge attachment wall 24 and/or it may be further attached to the wall 24 such as with a load distributing structure such as nut 38. The mechanical attachment scheme illustrated in FIG. 2 may provide the sole means for attachment between the elements 12, 18, or it may augment the attachment provided by an adhesive 40 or sinter bond.

Figure 3:
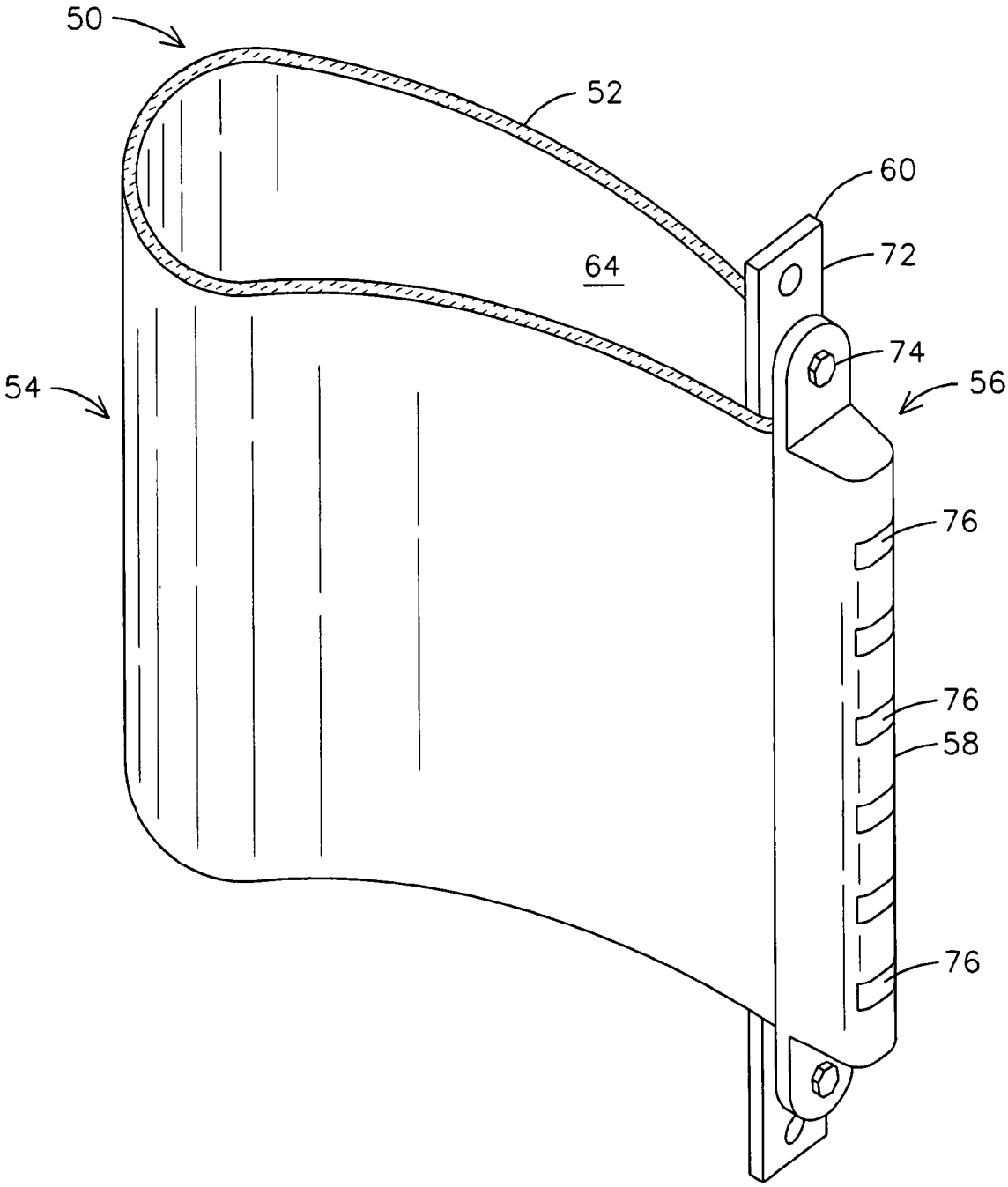
FIG. 3 is a perspective view of an airfoil having a trailing edge element supported by a cooling air insert.
Figure 4:
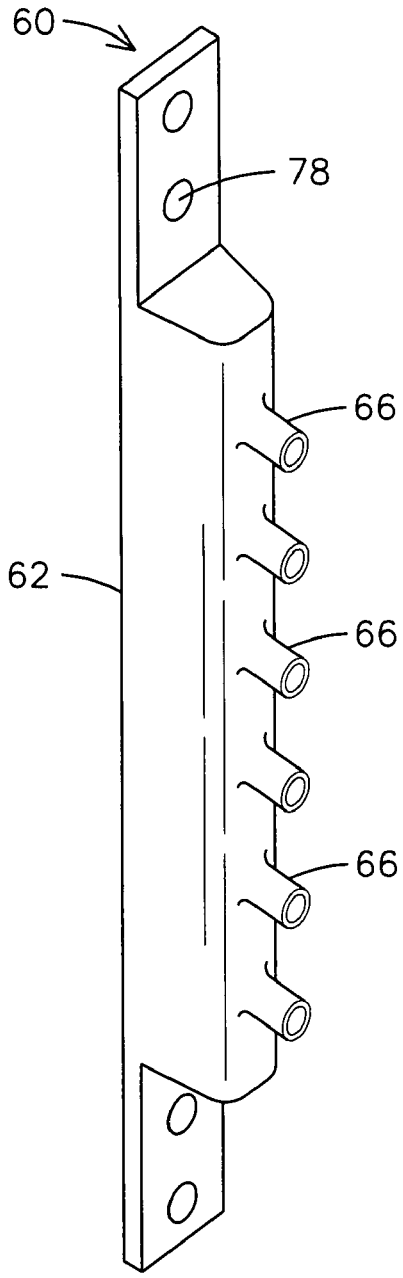
FIG. 4 is a perspective view of the cooling air insert of the airfoil of FIG. 3.
Figure 5:
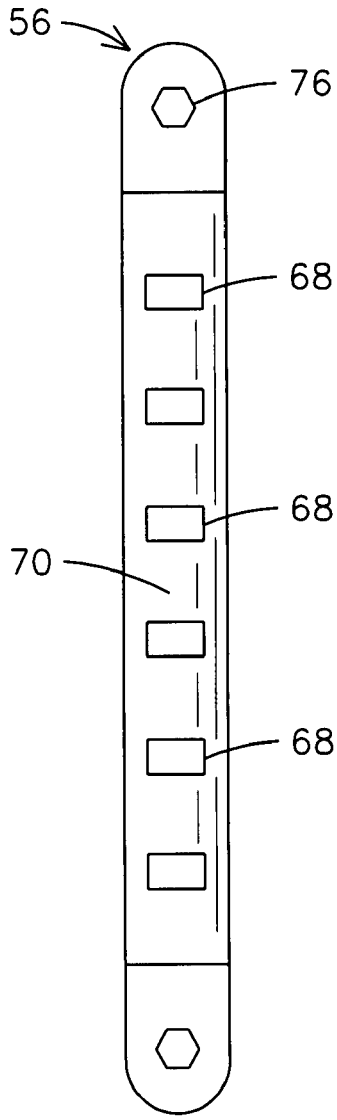
FIG. 5 is a rear view of the trailing edge element of FIG. 3.

FIG. 3 illustrates another embodiment of the present invention where an airfoil 50 includes a ceramic matrix composite element 52 defining a leading edge 54 of the airfoil 50 and extending along at least 70% of a chord length of the airfoil 50, and a trailing edge element 56 attached to the ceramic matrix composite element 52 and defining a trailing edge 58 of the airfoil 50. In this embodiment, the trailing edge element 58 is supported by the CMC element 52 and by a cooling air insert 60, as may be appreciated by the following description and by viewing FIGS. 3-5 in concert. In this embodiment, the cooling air insert 60 includes a body portion 62 that is formed to fit within the CMC element 52 proximate the trailing edge attachment wall and in fluid communication with a cooling fluid cavity 64 of the CMC element 52. The cooling air insert 60 also includes a plurality of cooling tubes 66 that extend through the trailing edge attachment wall of the ceramic matrix composite element 52 into the trailing edge element 56 for delivering cooling fluid from the CMC element 52 to the generally hollow trailing edge element 56. The cooling tubes 66 penetrate the trailing edge element 56 through a respective plurality of holes 68 formed in the chord attachment wall 70 of the trailing edge element 56. In this embodiment the cooling tubes 66 function as an interlock element as described above with respect to FIG. 2. The cooling tubes 66 may provide a mechanical support function, and/or the cooling air insert 60 may include an attachment portion 72 extending beyond a hot gas path portion of the ceramic matrix composite element 52, and a means for attachment between the attachment portion 72 of the cooling air insert 60 and the trailing edge element 56. The means for attachment is illustrated herein as including a bolt 74 for passing through aligned holes 76, 78 of the trailing edge element 56 and cooling air insert 60, although other mechanisms for attachment such as clamps, screws, hooks, adhesives, etc. may be used. The cooling air insert 60 and/or the trailing edge element 56 may further be supported directly or indirectly from surrounding structures (e.g. a vane shroud, not shown) and/or from the CMC element 52. The primary support of the trailing edge element may be provided by the surrounding structures, by an interlock element, or by a bond, etc., and the support may be augmented by any other(s) of such means for support. The trailing edge element 56 may further include cooling air outlet holes 76 in fluid communication with the cooling tubes 66 of the cooling air insert 60.

Figure 6:
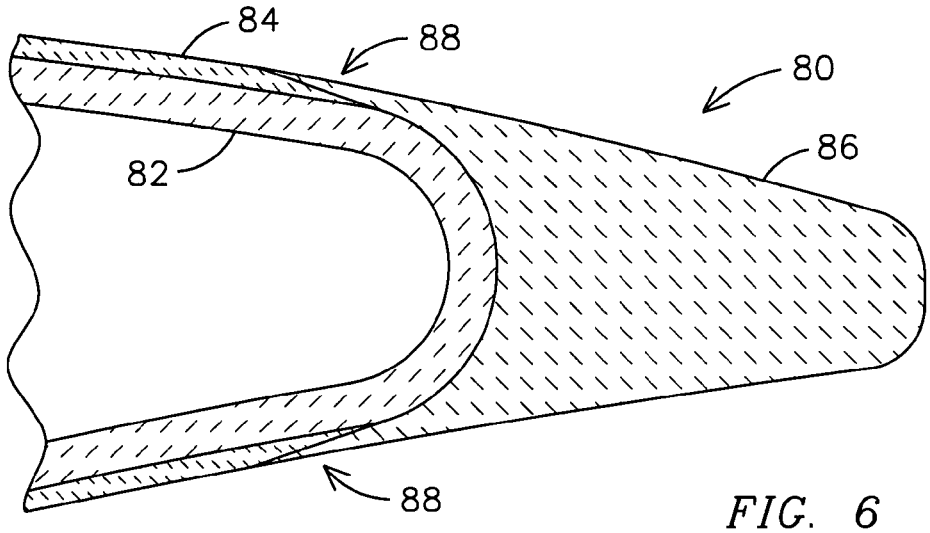
FIG. 6 is a partial cross-sectional view of another embodiment of the invention.

FIG. 6 illustrates another embodiment of the present invention wherein an airfoil 80 includes a CMC chord element 82 covered by a layer of ceramic insulating material 84 such as the friable-grade insulation (FGI) described in U.S. Pat. No. 6,197,424, and a trailing edge element 86, which may also formed of the FGI material. The trailing edge element 86 may be joined to the CMC chord element 82 by a sinter bond or other mechanism described above. In this embodiment, the trailing edge element 86 is integrated with the airfoil shape of the chord element 82 and its layer of insulating material 84 by extending the FGI material of the trailing edge element 86 in the chord direction to form a tapered thickness region 88 in contact with the layer of ceramic insulating material to some distance on the chord element 82.

Advantageously, an airfoil of the present invention avoids any small bend radius problems for fibers of the ceramic matrix composite material forming the leading edge and chord portion of the airfoil, while at the same time providing a suitable thin trailing edge that allows the airfoil design to be optimized from an aerodynamic performance perspective. The gap between the CMC element and trailing edge element may be very tight and formed to have minimal aerodynamic effect, and may be made nonexistent in certain embodiments through the use of filler/adhesive materials. Materials of construction, material fabrication processes, and material joining processes that are well known in the art may be used for the present invention.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An airfoil comprising:

a ceramic matrix composite element defining a leading edge portion and a chord portion of an airfoil;

a trailing edge element supported by the ceramic matrix composite element and defining a trailing edge portion of the airfoil; and a layer of ceramic insulating material disposed over the ceramic matrix composite element;

wherein the trailing edge element comprises a ceramic material extending in a chord direction to form a tapered thickness region in contact with the layer of ceramic insulating material disposed over the ceramic matrix composite element to some distance in the chord direction on the ceramic matrix composite element.

2. The airfoil of claim 1, wherein the trailing edge element is bonded to the chord portion of the ceramic matrix composite element.

3. The airfoil of claim 1, wherein the trailing edge element is mechanically attached to the chord portion of the ceramic matrix composite element.

4. The airfoil of claim 1, wherein the trailing edge portion comprises an attachment wall abutting the chord portion, and further comprising an interlock element extending from a first of the group of the trailing edge attachment wall and a wall of the ceramic matrix composite element to penetrate a second of the group of the trailing edge attachment wall and the wall of the ceramic matrix composite element.

5. The airfoil of claim 1, further comprising a cooling fluid insert in fluid communication with a cooling fluid cavity of the chord portion and comprising a cooling tube extending through a trailing edge attachment wall of the ceramic matrix composite element into the trailing edge element for delivering cooling fluid from the ceramic matrix composite element to the trailing edge element.

6. The airfoil of claim 5, wherein the trailing edge element is supported by the cooling fluid insert.

7. The airfoil of claim 1, wherein the trailing edge portion comprises a non-structural ceramic insulating material.

8. An airfoil comprising:

a ceramic matrix composite element defining a leading edge of an airfoil and extending along at least 70% of a chord length of the airfoil;

a trailing edge element attached to the ceramic matrix composite element and defining a trailing edge of the airfoil; and a layer of ceramic insulating material disposed over the ceramic matrix composite element;

wherein the trailing edge element comprises a ceramic material extending in a chord direction to form a tapered thickness region in contact with the layer of ceramic insulating material to some distance in the chord direction on the ceramic matrix composite element.

9. The airfoil of claim 8, wherein the ceramic matrix composite element extends along at least 90% of the chord length of the airfoil.

10. The airfoil of claim 8, wherein the ceramic matrix composite element comprises a trailing edge attachment wall comprising a bend radius sufficiently large to avoid damage to ceramic reinforcing fibers of the wall, and wherein the trailing edge element comprises a chord attachment wall configured to cooperate with the trailing edge attachment wall for attachment thereto.

11. The airfoil of claim 10, further comprising an interlock feature extending between the chord attachment wall and the trailing edge attachment wall to provide a mechanical interlock there between.

12. The airfoil of claim 8, wherein the trailing edge element is mechanically attached to the ceramic matrix composite element.

13. The airfoil of claim 8, further comprising:

a cooling air cavity defined by a wall of the ceramic matrix composite element;

a cooling air insert partially disposed in the cooling air cavity and comprising a plurality of cooling tubes extending through the wall of the ceramic matrix composite element and into the trailing edge element for delivering cooling air from the cooling air cavity to the trailing edge element.

14. The airfoil of claim 13, wherein the cooling air insert comprises an attachment portion extending beyond a hot gas path portion of the ceramic matrix composite element; and a means for attachment between the attachment portion of the cooling air insert and the trailing edge element.

15. An airfoil comprising:

a ceramic matrix composite element defining a leading edge of an airfoil and extending along at least 70% of a chord length of the airfoil; and a trailing edge element attached to the ceramic matrix composite element and defining a trailing edge of the airfoil;

wherein the ceramic matrix composite element comprises a trailing edge attachment wall comprising a bend radius sufficiently large to avoid damage to ceramic reinforcing fibers of the wall, and wherein the trailing edge element comprises a chord attachment wall configured to cooperate with the trailing edge attachment wall for attachment thereto; and wherein the trailing edge element comprises a ceramic material and the trailing edge attachment wall is sinter bonded to the chord attachment wall.

16. An airfoil comprising:

a ceramic matrix composite element defining a leading edge of an airfoil and extending along at least 70% of a chord length of the airfoil; and a trailing edge element attached to the ceramic matrix composite element and defining a trailing edge of the airfoil;

wherein the ceramic matrix composite element comprises a trailing edge attachment wall comprising a bend radius sufficiently large to avoid damage to ceramic reinforcing fibers of the wall, and wherein the trailing edge element comprises a chord attachment wall configured to cooperate with the trailing edge attachment wall for attachment thereto; and wherein the trailing edge attachment wall is adhesively bonded to the chord attachment wall.

* * * * *